US011596823B2

(12) United States Patent
Meruva et al.

(10) Patent No.: US 11,596,823 B2
(45) **Date of Patent: *Mar. 7, 2023**

(54) OPERATING A FIRE CONTROL SYSTEM

(71) Applicant: Honeywell International Inc., Charlotte, NC (US)

(72) Inventors: Jayaprakash Meruva, Bangalore (IN); Rajesh Babu Nalukurthy, Bangalore (IN); Vipindas E K, Kannur (IN); Amit Jain, Bangalore (IN); Rich Lau, New York City, NY (US); Jesse Otis, North Haven, CT (US)

(73) Assignee: Honeywell International Inc., Charlotte, NC (US)

( * ) Notice: Subject to any disclaimer, the term of this patent is extended or adjusted under 35 U.S.C. 154(b) by 127 days.

This patent is subject to a terminal disclaimer.

(21) Appl. No.: 16/992,927

(22) Filed: Aug. 13, 2020

(65) Prior Publication Data

US 2020/0376311 A1 Dec. 3, 2020

Related U.S. Application Data

(63) Continuation of application No. 16/425,383, filed on May 29, 2019, now Pat. No. 11,083,919.

(51) Int. Cl.

| | |
|---|---|
| ***G08B 17/06*** | (2006.01) |
| ***G08B 25/10*** | (2006.01) |
| ***A62C 37/36*** | (2006.01) |
| *G06Q 50/10* | (2012.01) |

(52) U.S. Cl.

CPC ..... *A62C 37/04* (2013.01); *G08B 17/06* (2013.01); *G08B 25/10* (2013.01); *G06Q 50/10* (2013.01)

(58) Field of Classification Search

CPC ..... A62C 37/04; G08B 17/06; G08B 25/10; G08B 25/001; G08B 25/08; G06Q 50/10

See application file for complete search history.

(56) References Cited

U.S. PATENT DOCUMENTS

| | | | | |
|---|---|---|---|---|
| 7,113,090 | B1 * | 9/2006 | Saylor | G08B 25/005 340/539.18 |
| 8,909,926 | B2 | 12/2014 | Brandt et al. | |
| 9,489,814 | B1 | 11/2016 | Pettigrew et al. | |
| 10,051,349 | B2 | 8/2018 | Schattmaier et al. | |
| 10,074,254 | B2 * | 9/2018 | Piccolo, III | G08B 25/14 |

(Continued)

OTHER PUBLICATIONS

Extended European Search Report for related EP Application No. 20177615.0, dated Oct. 30, 2020 (9 pgs).

(Continued)

*Primary Examiner* — Hoi C Lau

(74) *Attorney, Agent, or Firm* — Brooks, Cameron & Huebsch, PLLC

(57) ABSTRACT

Operating a fire control system is described herein. One method includes receiving, at a gateway device, first operational data of a first format from a control panel, determining a model associated with the control panel based on the first operational data, wherein the model includes correlations between the first operational data and alarm information of a second format, receiving second operational data of the first format from the control panel, and determining alarm information of the second format associated with the second operational data based on the model.

20 Claims, 4 Drawing Sheets

(56) References Cited

U.S. PATENT DOCUMENTS 10,084,638 B2 9/2018 Breed et al.
10,140,839 B1 * 11/2018 Smith ..... G08B 25/001
10,156,959 B2 12/2018 Fulker et al.
10,296,269 B1 * 5/2019 Bermundo ..... G06F 3/1209
11,083,919 B2 * 8/2021 Meruva ..... G08B 17/06
2003/0067889 A1 * 4/2003 Petite ..... G08B 25/009 370/310
2006/0271695 A1 * 11/2006 Lavian ..... G06F 21/552 709/229
2007/0055698 A1 * 3/2007 McCoy ..... G06Q 50/08
2007/0055758 A1 * 3/2007 McCoy ..... H04L 12/281 709/223
2007/0081634 A1 * 4/2007 Elliot ..... H04M 11/045 379/37
2007/0112646 A1 * 5/2007 Seeley ..... G06Q 30/0601 705/26.1
2008/0084291 A1 * 4/2008 Campion ..... G08B 29/145 340/514
2008/0309449 A1 * 12/2008 Martin ..... G08B 25/08 340/3.1
2009/0323904 A1 * 12/2009 Shapiro ..... H04M 11/04 379/39
2010/0071053 A1 * 3/2010 Ansari ..... H04W 12/065 709/206
2012/0027010 A1 * 2/2012 Elliot ..... H04L 12/413 370/352
2012/0154141 A1 * 6/2012 Piccolo, III ..... G08B 25/003 340/539.11
2012/0163352 A1 * 6/2012 Bansal ..... H04L 43/0852 370/338
2012/0260184 A1 * 10/2012 Dawes ..... G08B 25/008 715/736
2013/0273886 A1 * 10/2013 Mohajeri ..... H04W 12/02 455/411
2014/0359101 A1 * 12/2014 Dawes ..... G06F 3/04886 709/223
2015/0097664 A1 * 4/2015 Breed ..... G08B 29/00 340/506
2015/0142898 A1 * 5/2015 Piccolo, III ..... G08B 17/00 709/204
2015/0194039 A1 * 7/2015 Martin ..... G08B 21/182 340/632
2016/0335883 A1 * 11/2016 Breed ..... G08B 29/12

OTHER PUBLICATIONS

Hamins, et al., "Smart Firefighting", Workshop Summary Report, National Institute of Standards and Technology, https://dx.doi.org/10.6028/NIST.SP.1174, Mar. 24-25, 2014, 103 pages.

* cited by examiner

OPERATING A FIRE CONTROL SYSTEM

PRIORITY INFORMATION

This application is a Continuation of U.S. application Ser. No. 16/425,383, filed May 29, 2019, the contents of which are incorporated herein by reference.

TECHNICAL FIELD

The present disclosure relates generally to methods, devices, and systems for operating a fire control system.

BACKGROUND

Large facilities (e.g., buildings), such as commercial facilities, office buildings, hospitals, and the like, may have fire control systems that can be used to prevent a fire from occurring in a facility, detect a fire occurring in the facility, and/or manage a fire occurring in the facility. A fire control system may include a number of components located throughout the facility. For example, a fire control system may include sensors (e.g., smoke detectors) that can sense a fire occurring in the facility, alarms that can provide a notification of the fire to the occupants of the facility, fans and/or dampers that can perform smoke control operations (e.g., pressurizing, purging, exhausting, etc.) during the fire, and/or sprinklers that can provide water to extinguish the fire, among other components. A fire control system may also include a physical fire control panel (e.g., box) installed in the facility that can be used by a user to directly control the operation of the components of the fire control system.

A gateway device may be used by a user (e.g., maintenance technician or operator) to perform inspections, maintenance, and/or upgrades, among other operations, on a fire control system (e.g., on the components of the fire control system) of a facility. For instance, the user may connect the gateway device to the fire control panel of the fire control system, and the gateway device can use a communication protocol to communicate with the fire control panel to perform the tasks of the operation. A gateway device can also be connected (e.g., permanently connected) to the fire control system to collect data for remote monitoring and/or anomaly detection (e.g., through analytics).

DETAILED DESCRIPTION

Figure 1:
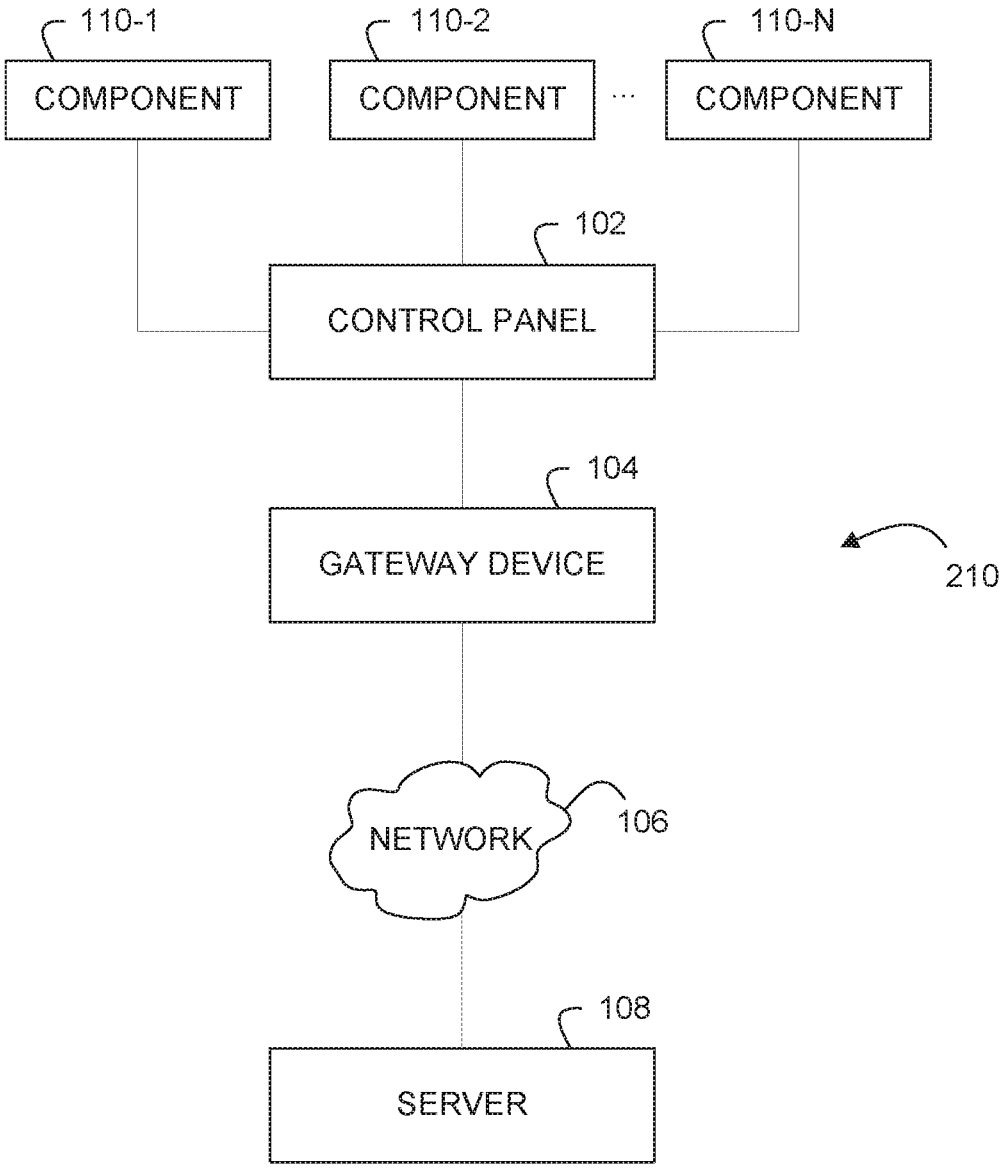
FIG. 1 illustrates an example of a fire control system in accordance with an embodiment of the present disclosure.

Operating a fire control system is described herein. For example, an embodiment includes receiving, at a gateway device, first operational data of a first format from a control panel, determining a model associated with the control panel based on the first operational data, wherein the model includes correlations between the first operational data and alarm information of a second format, receiving second operational data of the first format from the control panel, and determining alarm information of the second format associated with the second operational data based on the model.

Previous approaches to operating a fire control system may only be feasible with one specific type (e.g. brand) of fire control panel. For instance, previous gateway devices may be configured with only one specific type of communication protocol, and hence may only be capable of communicating with the type of fire control panel that supports that specific communication protocol.

As such, a user (e.g., maintenance technician or operator) who is performing operations, such as an inspections, maintenance, and/or upgrades, on fire control systems of different facilities (e.g., on the components of the fire control system) using previous gateway devices may need to carry multiple types of gateway devices to account for the many different types of fire control panels that may be present at different facilities, and in some instances may not have a gateway device that is usable with a particular fire control panel at a facility. Further, it may be difficult for the user in the field to determine which type of gateway device is usable with a particular fire control panel at a facility. These issues can result in a loss of productivity for the user, which can increase the amount of time and/or cost involved in performing such operations.

Moreover, certain advanced services (e.g., software services) that provide managerial control over one or more fire control systems may be supported for only a single brand of fire control panel. In some cases, for instance, such services may not be able to understand a protocol and/or language (hereinafter "format") used by a fire control panel of a different brand. If a gateway cannot communicate with differently branded fire control panels and understand their different formats of events, alarms, and/or device profiles, the services may not be usable. Such services can include, for example, inspection of alarms, facility management, remote diagnosis of alarms, and/or connectivity to central alarm system(s). In previous approaches, facility managers desiring to use such services may be frustrated to learn that their fire control panel is unsupported.

In contrast, embodiments in accordance with the present disclosure can "learn" the language spoken by different fire control panels and translate that language into one supported by advanced services. Consequently, these services can be enabled for a given fire control system, regardless of its brand.

As will be described further herein, raw data from a fire control panel can be analyzed during a learning phase and a mapping can be created that correlates certain portions of the raw data with alarm instances (sometimes referred to herein as "alarms"). After the learning phase, embodiments herein can receive raw data from the fire control panel and, based on the mapping, provide the corresponding alarms to the remote services (referred to generally herein as "server"). The server can store different mappings for different types or brands of fire control panels. Thus, regardless of the specifics of a given control panel in a fire control system, embodiments herein can receive its data and provide advanced services to the fire control system.

In the following detailed description, reference is made to the accompanying drawings that form a part hereof. The drawings show by way of illustration how one or more embodiments of the disclosure may be practiced.

These embodiments are described in sufficient detail to enable those of ordinary skill in the art to practice one or more embodiments of this disclosure. It is to be understood that other embodiments may be utilized and that mechanical, electrical, and/or process changes may be made without departing from the scope of the present disclosure.

As will be appreciated, elements shown in the various embodiments herein can be added, exchanged, combined, and/or eliminated so as to provide a number of additional embodiments of the present disclosure. The proportion and the relative scale of the elements provided in the figures are intended to illustrate the embodiments of the present disclosure, and should not be taken in a limiting sense.

The figures herein follow a numbering convention in which the first digit or digits correspond to the drawing figure number and the remaining digits identify an element or component in the drawing. Similar elements or components between different figures may be identified by the use of similar digits. For example, 101 may reference element "01" in FIG. 1, and a similar element may be referenced as 104 in FIG. 2.

As used herein, "a", "an", or "a number of" something can refer to one or more such things, while "a plurality of" something can refer to more than one such things. For example, "a number of components" can refer to one or more components, while "a plurality of components" can refer to more than one component. Additionally, the designator "N" as used herein, particularly with respect to reference numerals in the drawings, indicates that a number of the particular feature so designated can be included with a number of embodiments of the present disclosure. This number may be the same or different between designations.

FIG. 1 illustrates an example of a fire control system 100 in accordance with an embodiment of the present disclosure. The fire control system 100 can be the fire control system of a facility (e.g., building), such as, for instance, a large facility having a large number of floors, such as a commercial facility, office building, hospital, and the like. However, embodiments of the present disclosure are not limited to a particular type of facility As shown in FIG. 1, fire control system 100 can include a plurality of components 110-1, 110-2, . . . , 110-N located throughout a facility (e.g., on different floors of the facility) that can be used to detect and/or manage a fire occurring in the facility, and/or to prevent a fire from occurring in the facility. For example, components 110-1, 110-2, . . . , 110-N may include sensors (e.g., smoke detectors) that can sense a fire occurring in the facility, alarms that can provide a notification of the fire to the occupants of the facility, fans and/or dampers that can perform smoke control operations (e.g., pressurizing, purging, exhausting, etc.) during the fire, and/or sprinklers that can provide water to extinguish the fire, among other components.

As shown in FIG. 1, fire control system 100 can include a control panel (e.g., fire control panel) 102. Control panel 102 can be any different type (e.g., brand) of fire control panel. For instance, control panel 102 can be any different type of physical control panel, such as a control box, installed in a facility.

Control panel 102 can be used by a user to monitor and/or control components 110-1, 110-2, . . . , 110-N. For instance, the user can use control panel 102 to directly control the operation of (e.g., actions performed by) components 110-1, 110-2, . . . , 110-N. Further, control panel 102 can receive (e.g., collect) data, such as, for instance, real-time operational data, associated with components 110-1, 110-2, . . . , 110-N. For instance, control panel 102 can receive the data directly from components 110-1, 110-2, . . . , 110-N. Such data can include, for instance, current operational statuses, operational states, and/or properties of components 110-1, 110-2, . . . , 110-N.

Gateway device 104 can be used by a user (e.g., maintenance technician or operator) to perform inspections, maintenance, and/or upgrades, among other operations, on components 110-1, 110-2, . . . , 110-N. For example, as previously described herein (e.g., in connection with FIG. 1), gateway device 104 can be connected to control panel 102, and can communicate with control panel 102 to receive the data associated with components 110-1, 110-2, . . . , 110-N collected by control panel 102. In some embodiments, the gateway device 104 can be a mobile device. In some embodiments, the gateway device 104 may be permanently installed and/or connected at the facility. The gateway device 104 can continuously send (e.g., push) the data collected by control panel 102 to a centralized server (e.g., server 108) for detection of anomalies or other issues in the fire control system 100 of the facility.

As shown in FIG. 1, fire control system 100 can include a server 108. Server 108 can be located remotely from the facility and, in some embodiments, can be part of and/or coupled to a computing device that is part of a centralized management platform.

Gateway device 104 can communicate with server 108 via network 106, as illustrated in FIG. 1. For example, gateway device 104 can detect connectivity to network 106, and send (e.g., transmit and/or upload) the data associated with components 110-1, 110-2, . . . , 110-N to server 108 via network 106. Network 106 can be a network relationship through which gateway device 104 and sever 108 can communicate. Examples of such a network relationship can include a distributed computing environment (e.g., a cloud computing environment), a wide area network (WAN) such as the Internet, a local area network (LAN), a personal area network (PAN), a campus area network (CAN), or metropolitan area network (MAN), among other types of network relationships. For instance, network 106 can include a number of servers that receive information from, and transmit information to, gateway device 104 and server 108 via a wired or wireless network.

As used herein, a "network" can provide a communication system that directly or indirectly links two or more computers and/or peripheral devices and allows users to access resources on other computing devices and exchange messages with other users. A network can allow users to share resources on their own systems with other network users and to access information on centrally located systems or on systems that are located at remote locations. For example, a network can tie a number of computing devices together to form a distributed control network (e.g., cloud).

A network may provide connections to the Internet and/or to the networks of other entities (e.g., organizations, institutions, etc.). Users may interact with network-enabled software applications to make a network request, such as to get a file or print on a network printer. Applications may also communicate with network management software, which can interact with network hardware to transmit information between devices on the network.

Figure 2:
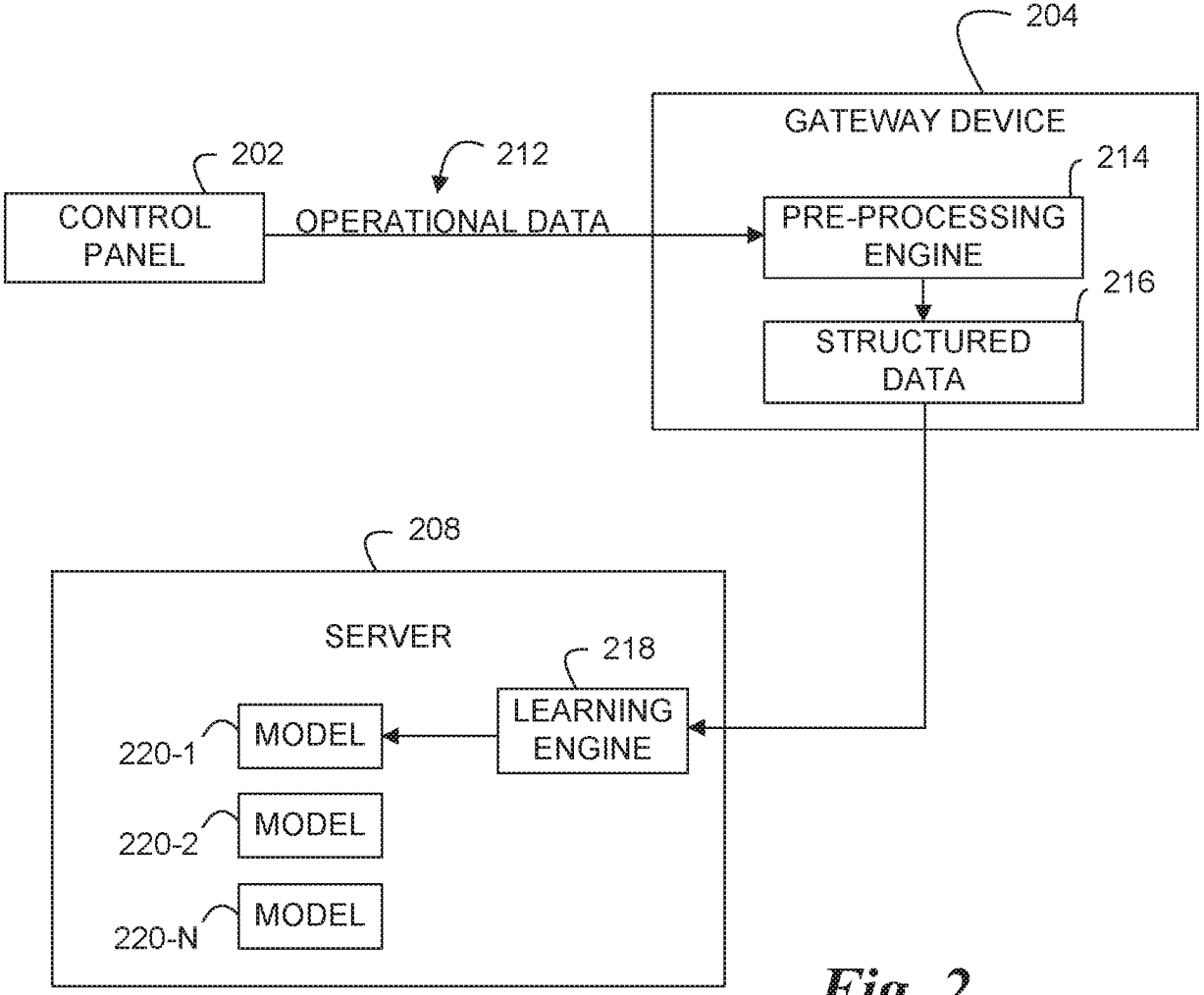
FIG. 2 illustrates a flow chart associated with operating a fire control system in accordance with an embodiment of the present disclosure.

FIG. 2 illustrates a flow chart associated with operating a fire control system in accordance with an embodiment of the present disclosure. As shown in FIG. 2, the flow chart includes a control panel 202, a gateway device 204, and a server 208, which can be respectively analogous to the control panel 102, the gateway device 104, and the server 108, previously described in connection with FIG. 1.

The flow chart illustrated in FIG. 2 can describe a "learning phase" in accordance with embodiments herein. In the learning phase, the gateway device 204 can connect to the control panel 202. In some embodiments, the gateway device 204 can be connected to the control panel 202 via an interface of the control panel 202. The interface can be a peripheral port of the control panel 202. For example, the interface can be a printer port of the control panel 202. It is noted that embodiments herein are not so limited, however. For instance, the interface can be an ethernet interface of the control panel, a Wi-Fi interface of the control panel, a public switched telephone network (PSTN) interface of the control panel, a universal serial bus (USB) interface of the control panel, a recommended standard (RS) interface of the control panel, and/or a transistor-transistor logic (TTL) interface of the control panel, among others.

The gateway device 204 can receive operational data 212 from the control panel 202. The operational data 212 received during the learning phase may be referred to herein as "first operational data." The first operational data 212 can be of a first format. The first format can be a raw data format (e.g., raw data packets). The first format can be a raw text format. The first format can be a raw binary format. In some embodiments, The first format can be a normal text format. In some embodiments, the first format can be a format known to those of skill in the art to be output from a printer port of a fire control panel (e.g., raw text format). The learning phase can be performed for a period of time. In some embodiments, the period of time exceeds 24 hours. In some embodiments, the period of time is between 24 and 48 hours. It is noted that embodiments of the present disclosure do not limit the period of time, however. The period of time can extend until sufficient data (e.g., first operational data 212) is collected. In some embodiments, a duration of the period of time is user-configurable (e.g., determined and/or set). The first operational data 212 can be received by the gateway device 204 over a period of time corresponding to the learning phase. The period of time can include one or more alarms (e.g., fire alarms), troubles, and/or events. It is noted that the term "alarm" where referred to herein is intended to include alarms, troubles, and/or events. A "trouble" as referred to herein, can include issues associated with a device. For instance, if a smoke detector is removed from an installation location and/or receptacle (e.g., base), a trouble can be raised. In some embodiments, device contamination levels exceeding a threshold or a device entering into end of life can raise a trouble. An "event" as referred to herein can generally include alarms and/or troubles. System faults, such as low battery, drained power supply, network communication failure, and/or temporary device disablement can be events. In some embodiments, other information, such as a laptop being connected to the system and/or a panel door being opened can be events.

A pre-processing engine 214 of the gateway device 204 can perform pre-processing of the first operational data 212. In some embodiments, pre-processing can include converting first operational data 212 of the raw format to first operational data of a structured format 216. Converting the raw operational data 212 to the structured operational data 216 can include removing new line characters from the raw operational data 212. Converting the raw operational data 212 to structured operational data 216 can include removing blank spaces from the raw operational data 212. Generally, pre-processing of the raw operational data 212 to convert the raw operational data 212 to the structured operational data 216 can include cleaning, instance selection, normalization, transformation, feature extraction, feature selection, etc.

The gateway device 204 can communicate the structured operational data 216 to the server 208 (e.g., to a learning engine 218 of the server 208). The learning engine 218 can perform machine learning techniques (e.g., deep learning techniques) on the structured operational data 216. The learning techniques can be performed in multiple stages. In some embodiments, a first stage can be performed to determine different portions of the structured operational data 216, a second stage can be performed to determine a role of each of the portions of the structured operational data 216, and a third stage can be performed to determine a type and/or format of the structured operational data 216.

Depending on a type (e.g., brand, make, model, etc.) of the control panel 202, certain data structures can be mapped between a format supported by the control panel 202 (e.g., the operational data 212) and a format supported by the server 208 and services provided by the server 208. Accordingly, descriptions of different alarms in a first format supported by the control panel 202 can be mapped to descriptions of those alarms in a second format supported by the server 208. Device information, including descriptions of events and/or alarms, in a format supported by the server 208 are herein referred to as "alarm information of a second format" or "alarm information." Stated differently, alarm information can include current operational statuses, operational states, and/or properties of components (e.g., components 110-1, 110-2, . . . , 110-N) in a format supported by the server 208.

Upon analyzing a number of alarms described by the structured data 216, the learning engine 218 can determine (e.g., generate) a model 220-1 that correlates the first operational data 212 of the control panel 202 with the alarm information of the second format. The model can be stored by the server 208 (e.g., in memory) for later retrieval. As shown in FIG. 2, multiple models can be stored, each associated with a different brand of control panel. Accordingly, the steps of the learning phase discussed above can be repeated for different brands of control panels (e.g., a first brand, a second brand, a third brand, a fourth band, etc.) and different models can be determined. These different models are illustrated as models 220-1, 220-2, . . . , 220-N, which may be referred to collectively herein as "models 220."

Figure 3:
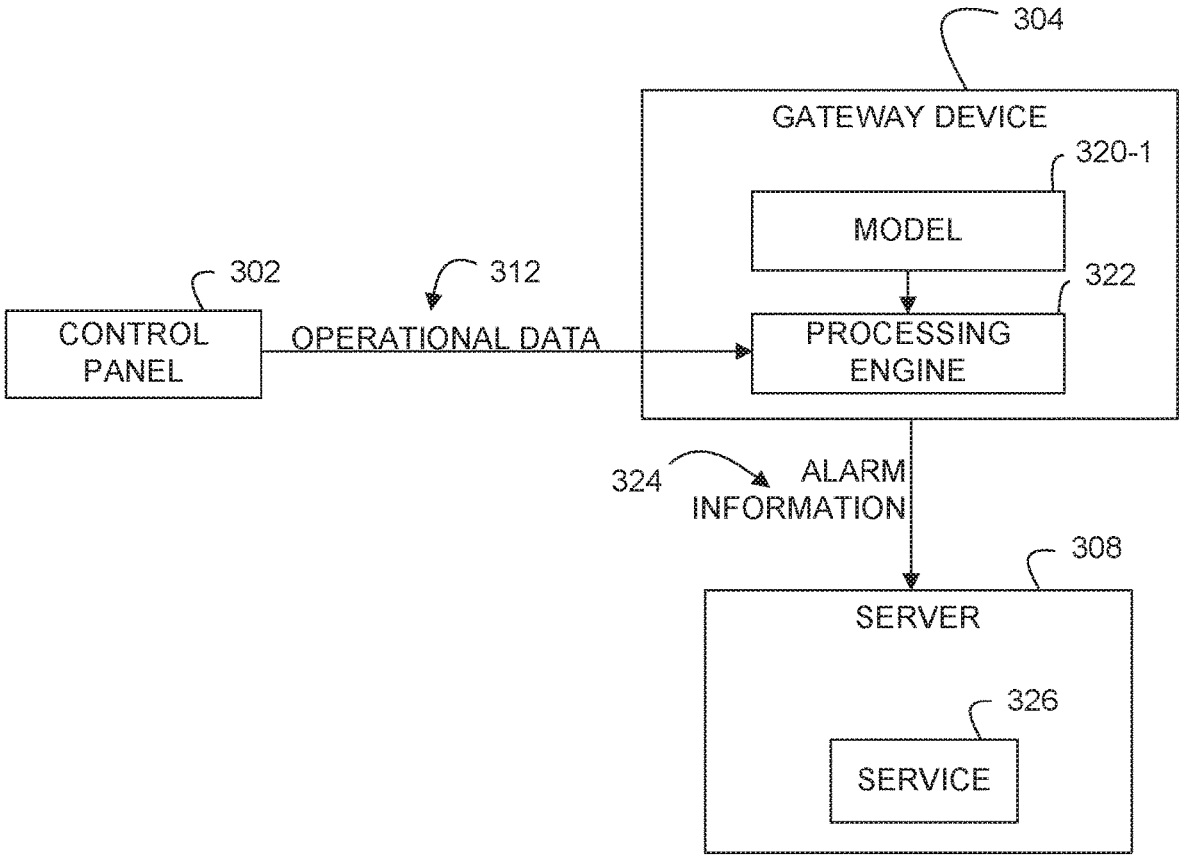
FIG. 3 illustrates another flow chart associated with operating a fire control system in accordance with an embodiment of the present disclosure.

FIG. 3 illustrates another flow chart associated with operating a fire control system in accordance with an embodiment of the present disclosure. As shown in FIG. 3, the flow chart includes a control panel 302, a gateway device 304, and a server 308, which can be respectively analogous to the control panel 202, the gateway device 204, and the server 208, previously described in connection with FIG. 2.

The flow chart illustrated in FIG. 3 can describe an "execution phase" in accordance with embodiments herein. The gateway device 304 can receive a model 320-1 previously determined to correspond with the control panel 302. The model 320-1 can be received (e.g., downloaded) from the server 326, for instance. During the Execution phase, operational data 312 can be received by the gateway device 304 from the control panel 302. The operational data 312 received during the execution phase may be referred to herein as "second operational data." The second operational data 312 can be of the first (e.g., raw) format previously described in connection with FIG. 2. In some embodiments, the model 320-1 can be received responsive to receiving the second operational data 312.

A processing engine 322 of the gateway device 304 can receive the second operational data 312 and the model 320-1. Based on the model 320-1, the processing engine 322 can determine alarm information 324 associated with the second operational data 312. The alarm information 324 can be of the second format (e.g., supported by the server 308) previously described in connection with FIG. 2. Once determined, the alarm information 324 can be communicated to the server 308. A service (e.g., software service) 326 executed on the server 308 can perform advanced operations on the alarm information and provide management functionalities to one or more users. The service 326 can, for example, enable detailed inspection of alarms, facility management, remote diagnosis of alarms, and/or connectivity to central alarm system(s). Accordingly, the service 326 can be utilized regardless of a type of the control panel 302 and/or a format of the operational data 312 output by the control panel 302. The service 326 can be provided by a web application and/or a mobile application, for instance. In an example, the service can determine a cause of an alarm from the operational data 312 and provide the determined cause to a user via a mobile application (e.g., running on a mobile device).

As used herein, the term "application" can refer to an application accessed through a mobile device. An "application" as described herein can also be accessed via a network or via the web.

As used herein, the term "mobile device" can refer to any device accessed by a user which is sufficiently portable. This can include, but is not limited to, cell phones (e.g., smart phones), tablets, and portable computers.

As used herein, a "network" can provide a communication system that directly or indirectly links two or more computer and/or mobile devices and allows users to access resources or other computing devices and exchange messages with other users. A network can allow users to share resources on their own systems with other network users and to access information on centrally located systems or on systems that are located at remote locations. For example, a network can tie a number of devices together to form a distributed control network (e.g., a cloud).

A network may provide connections to the Internet and/or to the networks of other entities (e.g., organizations, institutions, etc.). Users may interact with network-enabled software applications to make a network request. Applications may also communicate with network management software, which can interact with network hardware to transmit information between devices on the network.

As used herein, the term "cloud", or distributed control network, can be used to refer to a server and/or computing device working in conjunction with other computing resources (hardware, software, logic, memory, processor, etc.) that can be used as a service over a communications network (in a wired and/or wireless manner over the internet). The server, computing device, and other computing resources can all be referred to as being part of the "cloud".

Figure 4:
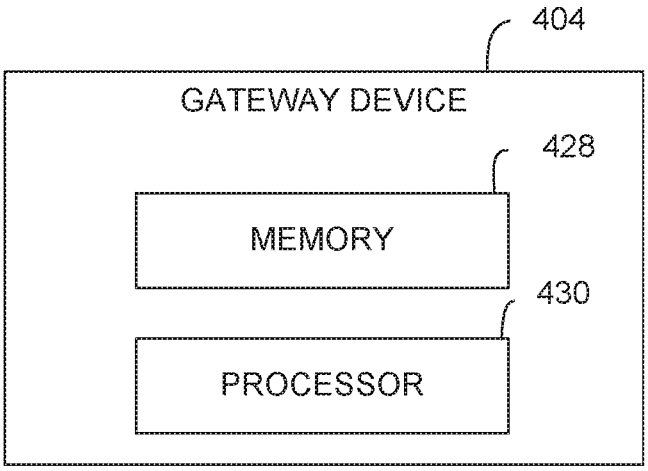
FIG. 4 illustrates an example of a gateway device for operating a fire control system in accordance with an embodiment of the present disclosure.

FIG. 4 illustrates an example of a gateway device 404 for operating a fire control system in accordance with one or more embodiments of the present disclosure. Gateway device 404 can be, for instance, gateway device 104, gateway device 204, and/or gateway device 304 previously described herein in connection with FIGS. 1, 2, and 3 respectively.

As shown in FIG. 4, gateway device 404 can include a processor 430 and a memory 428. Memory 428 can be any type of storage medium that can be accessed by processor 430 to perform various examples of the present disclosure. For example, memory 428 can be a non-transitory computer readable medium having computer readable instructions (e.g., computer program instructions) stored thereon that are executable by processor 430 to perform various examples of the present disclosure. That is, processor 430 can execute the executable instructions stored in memory 428 to perform various examples in accordance with the present disclosure.

Memory 428 can be volatile or nonvolatile memory. Memory 428 can also be removable (e.g., portable) memory, or non-removable (e.g., internal) memory. For example, memory 428 can be random access memory (RAM) (e.g., dynamic random access memory (DRAM), resistive random access memory (RRAM), and/or phase change random access memory (PCRAM)), read-only memory (ROM) (e.g., electrically erasable programmable read-only memory (EEPROM) and/or compact-disk read-only memory (CD-ROM)), flash memory, a laser disk, a digital versatile disk (DVD) or other optical disk storage, and/or a magnetic medium such as magnetic cassettes, tapes, or disks, among other types of memory.

Further, although memory 428 is illustrated as being located in gateway device 404, embodiments of the present disclosure are not so limited. For example, memory 428 can also be located internal to another computing resource (e.g., enabling computer readable instructions to be downloaded over the Internet or another wired or wireless connection). Further, it is noted that the server 108, the server 208, and the server 308 can include a processor and a memory (e.g., analogous to the memory 428 and the processor 430) configured to store instructions executable by the processor to perform various examples in accordance with the present disclosure. For example, memory of the server can be used to store models described herein.

Although specific embodiments have been illustrated and described herein, those of ordinary skill in the art will appreciate that any arrangement calculated to achieve the same techniques can be substituted for the specific embodiments shown. This disclosure is intended to cover any and all adaptations or variations of various embodiments of the disclosure.

It is to be understood that the above description has been made in an illustrative fashion, and not a restrictive one. Combination of the above embodiments, and other embodiments not specifically described herein will be apparent to those of skill in the art upon reviewing the above description.

The scope of the various embodiments of the disclosure includes any other applications in which the above structures and methods are used. Therefore, the scope of various embodiments of the disclosure should be determined with reference to the appended claims, along with the full range of equivalents to which such claims are entitled.

In the foregoing Detailed Description, various features are grouped together in example embodiments illustrated in the figures for the purpose of streamlining the disclosure. This method of disclosure is not to be interpreted as reflecting an intention that the embodiments of the disclosure require more features than are expressly recited in each claim.

Rather, as the following claims reflect, inventive subject matter lies in less than all features of a single disclosed embodiment. Thus, the following claims are hereby incorporated into the Detailed Description, with each claim standing on its own as a separate embodiment.

What is claimed is:

1. A method of operating a fire control system, comprising:

receiving first operational data from a control panel, wherein the first operational data is in a first format;

determining a model associated with the control panel based on the first operational data;

receiving second operational data from the control panel, wherein the second operational data is in the first format; and determining alarm information associated with the second operational data based on the model, wherein the alarm information is in a second format and includes descriptions of events and/or alarms associated with the fire control system.

2. The method of claim 1, wherein the model corresponds to a brand of the control panel.

3. The method of claim 1, wherein the method includes receiving the first operational data at a gateway device.

4. The method of claim 1, wherein the method includes receiving the first operational data from the control panel over a period of time.

5. The method of claim 1, wherein the method includes receiving the first operational data from the control panel in a raw text format.

6. The method of claim 1, wherein the method includes receiving the first operation data from the control panel in a raw binary format.

7. The method of claim 1, wherein the method includes storing the model.

8. The method of claim 7, wherein the method includes retrieving the model responsive to receiving the second operational data.

9. The method of claim 1, wherein the method includes:

receiving first operational data in the first format from an additional control panel;

determining an additional model associated with the additional control panel based on the first operational data from the additional control panel;

receiving second operational data in the first format from the additional control panel; and determining alarm information associated with the second operational data of the first format from the additional control panel based on the second model, wherein the alarm information is in the second format.

10. The method of claim 9, wherein the model includes a correlation between the first operational data and alarm information.

11. A gateway device for a fire control system, comprising:

a processor; and a memory having instructions stored thereon which, when executed by the processor, cause the processor to:

receive operational data from a control panel, wherein the operational data is in a first format;

retrieve a particular model from among a plurality of models in the memory, wherein the particular model corresponds to a brand of the control panel; and determine alarm information in a second format associated with the operational data based on the particular model.

12. The gateway device of claim 11, including instructions to retrieve the particular model from among the plurality of models based on the brand of the control panel.

13. The gateway device of claim 11, including instructions to communicate the alarm information in the second format to a remote server.

14. A fire control system, comprising:

a control panel;

a gateway device; and a server, wherein the gateway device is configured to:

receive operational data in a first format from the control panel;

retrieve a particular model from among a plurality of models stored in the server, wherein the particular model corresponds to a brand of the control panel;

determine alarm information in a second format associated with the operational data based on the particular model; and communicate the alarm information in the second format to the server; and wherein the server is configured to determine a cause of an alarm based on the alarm information in the second format.

15. The system of claim 14, wherein the gateway device is configured to receive the operational data from an interface of the control panel.

16. The system of claim 14, wherein the operational data is associated with a period of time in which the alarm occurred.

17. The system of claim 14, wherein each of the plurality of models is associated with a different brand of control panel.

18. The system of claim 14, wherein the server is configured to provide the determined cause of the alarm via a mobile application.

19. The system of claim 14, wherein the control panel and the gateway device are installed in a facility, and wherein the server is located remote from the facility.

20. The system of claim 19, wherein the system includes a different brand of control panel installed in the facility, and wherein the gateway device is connected to the different brand of control panel.

* * * * *